US005851085A

United States Patent [19]

Campbell

[11] Patent Number: 5,851,085

[45] **Date of Patent: *Dec. 22, 1998**

[54] METHOD AND APPARATUS FOR SPRAYING A TACK MATERIAL FROM A PAVING MACHINE HAVING A GRAVITY FEED HOPPER

[75] Inventor: Thomas R. Campbell, Chattanooga, Tenn.

[73] Assignee: Astec Industries, Inc., Chattanooga, Tenn.

[ * ] Notice: The term of this patent shall not extend beyond the expiration date of Pat. No. 5,533,828.

[21] Appl. No.: 777,774

[22] Filed: Dec. 30, 1996

Related U.S. Application Data

[63] Continuation-in-part of Ser. No. 389,257, Feb. 16, 1995, Pat. No. 5,533,828, and Ser. No. 314,348, Sep. 29, 1994, Pat. No. 5,615,973.

[51] Int. Cl.[6] ..... E01C 19/18

[52] U.S. Cl. ..... 404/75; 404/108; 404/110; 404/111

[58] Field of Search ..... 404/75, 79, 82, 404/101, 108, 110, 111

[56] References Cited

U.S. PATENT DOCUMENTS

| | | | |
|---|---|---|---|
| 1,729,574 | 9/1929 | Finely . | |
| 1,865,109 | 6/1932 | Johnson . | |
| 3,016,809 | 1/1962 | McNeill | 94/46 |
| 3,613,530 | 10/1971 | Hess | 94/46 AC |
| 3,771,893 | 11/1973 | Miller | 404/101 |
| 3,867,162 | 2/1975 | Elste, Jr. . | |
| 3,909,474 | 9/1975 | Borchert et al. . | |
| 4,068,968 | 1/1978 | Gagle et al. | 404/7 |
| 4,072,435 | 2/1978 | Coho et al. | 404/110 |
| 4,073,592 | 2/1978 | Godberson et al. | 404/89 |
| 4,074,948 | 2/1978 | Heater, Jr. | 404/75 |
| 4,196,927 | 4/1980 | Leafdale | 222/146 H |
| 4,198,177 | 4/1980 | Ray, Jr. et al. | 404/75 |
| 4,215,949 | 8/1980 | Gabriel, Jr. | 404/110 |
| 4,245,785 | 1/1981 | Johansing, Jr. | 239/112 |
| 4,493,585 | 1/1985 | Axer | 404/102 |
| 4,534,674 | 8/1985 | Cutler | 404/75 |
| 4,676,689 | 6/1987 | Yant | 404/110 |
| 4,684,289 | 8/1987 | Gnesa | 404/75 |
| 4,695,186 | 9/1987 | King | 404/111 |
| 4,759,657 | 7/1988 | Dörr et al. | 404/72 |
| 4,765,772 | 8/1988 | Benedetti et al. | 404/77 |
| 4,793,731 | 12/1988 | Gnesa | 404/83 |
| 4,820,078 | 4/1989 | Brocious | 404/92 |
| 4,828,429 | 5/1989 | Kirchner et al. | 404/111 |
| 4,944,632 | 7/1990 | Dillingham | 404/111 |
| 4,958,955 | 9/1990 | Laditka | 404/75 |
| 5,054,959 | 10/1991 | Wilson et al. | 404/94 |
| 5,069,578 | 12/1991 | Bense et al. | 404/75 |
| 5,131,788 | 7/1992 | Hulicsko | 404/108 |
| 5,178,486 | 1/1993 | Perrin et al. | 404/101 |
| 5,232,305 | 8/1993 | Bassett et al. | 404/101 |
| 5,269,626 | 12/1993 | Soliman et al. | 404/108 |
| 5,279,500 | 1/1994 | Perrin et al. | 404/75 |
| 5,294,210 | 3/1994 | Lemelson | 404/84.1 |
| 5,324,136 | 6/1994 | Reymonet et al. | 404/107 |
| 5,360,287 | 11/1994 | Laditka | 404/75 |
| 5,533,828 | 7/1996 | Campbell | 404/75 |
| 5,533,829 | 7/1996 | Campbell | 404/81 |
| 5,615,973 | 4/1997 | Campbell | 404/75 |

*Primary Examiner*—James Lisehora
*Attorney, Agent, or Firm*—Nilles & Nilles, S.C.

[57] ABSTRACT

A paving machine employs in combination a gravity feed HMA hopper and a tack spray assembly and storage tank. Use of the gravity feed hopper permits all HMA or other paving material stored therein to be discharged directly on top of the paving machine's distributing auger. Moreover, because the gravity feed hopper takes up a relatively small percentage of the horizontal area of the paving machine, a chassis of standard or near standard dimensions can receive a tack storage tank of sufficient capacity to permit the paving machine to operate an entire day without stopping the machine to refill the storage tank. Therefore, if used in conjunction with an HMA shuttling apparatus, the paving machine can simultaneously coat a surface to be paved with a tack material and pave that surface with HMA for prolonged periods of time without stopping to refill either the HMA hopper of the tack storage tank.

20 Claims, 7 Drawing Sheets

METHOD AND APPARATUS FOR SPRAYING A TACK MATERIAL FROM A PAVING MACHINE HAVING A GRAVITY FEED HOPPER

CROSS REFERENCE TO RELATED APPLICATIONS

This application is a continuation-in-part of and commonly assigned application Ser. No. 08/389,257, filed Feb. 16, 1995 in the name of the inventor named in this application now U.S. Pat. No. 5,533,828, and a continuation-in-part of and commonly assigned application Ser. No. 08/314,348, filed Sep. 29, 1994 in the name of the inventor named in this application, now U.S. Pat. No. 5,615,973.

BACKGROUND OF THE INVENTION

1. Field of the Invention

The invention relates to paving machines and, more particularly, relates to a method and apparatus for improving the operation of a machine for paving hot mix asphalt (HMA) or the like by spraying tack from a paving machine having a gravity feed HMA hopper.

2. Discussion of the Related Art

Paving machines are well known for receiving paving materials such as HMA, distributing the paving materials onto a roadway or another surface, and working the materials into a mat. Such machines typically include a self-propelled tractor-like vehicle having a chassis; an engine mounted on the chassis for propulsion and for material distribution functions; a hopper mounted on the chassis; a helical screw type distributing auger mounted near the rear of the chassis; and a heated vibratory screed mounted on the chassis behind the distributing auger. In use, HMA is discharged from the hopper in one or more windrows in front of the distributing auger as the chassis travels in a forward direction. The distributor auger then distributes and levels the windrowed HMA, and the screed then compacts the distributed material into a mat.

Two problems arise from discharging materials onto the ground in front of the distributing auger as described above. First, it is difficult to resume paving from the end of a previously-paved segment. If the distributing auger and screed are placed at the end of the previously-paved segment, the HMA conveyor delivers materials at a location which is spaced from the previously-paved segment. The resulting gap between the materials and the end of the previously-paved segment cannot adequately be filled by the distributing auger, resulting in a rough transition area between paved segments. This drawback can be partially alleviated by positioning the discharge point of the HMA conveyor directly in front of the distributing auger. However, a significant gap and resulting rough area still remain.

Second, HMA materials tend to become segregated by weight and particle size when they are stored in and conveyed out of the hopper. Conventional conveyors pile this partially segregated HMA in front of a distributing auger, which then spreads the materials without significant remixing. Indeed, materials at the bottom of the windrows may not be disturbed by the distributing auger. This spreading without significant remixing may result in a poorer quality paved surface.

Another problem associated with conventional paving machines is that they are poorly suited to apply an underlayer of a tack material. "Tack" is commonly known in the art to encompass asphaltic emulsions, liquid asphalt, or a variety of other substances which are coated onto a surface to be paved prior to distributing and compacting the HMA into a mat to bind the HMA to the underlying surface.

Tack is typically applied, just prior to a paving operation, by being sprayed onto the surface to be paved from a spray bar extending transversely over the surface. A tack truck operated independently of the paving machine is normally used for this purpose. The typical tack truck includes a self-propelled chassis on which are mounted a tack storage tank and a tack spray assembly. The truck travels in front of the paving machine while coating the surface to be paved with a layer of tack. The truck travels at 5 to 10 miles per hour, considerably faster than the 20 or 40 feet per minute operational speed of the paving machine, and hence must periodically stop to wait for the paving machine and associated components of the system (if any) to catch up with the truck. Examples of tack application systems requiring mounting on a separate truck are disclosed in the U.S. Pat. No. 4,828,429 to Kirchner et al.; U.S. Pat. No. 4,864,289 to Gnesa; and U.S. Pat. No. 4,793,731 to Gnesa. Several disadvantages result from this technique.

First, the paving machine and possibly other machines such as a dump truck and/or a shuttling machine positioned between the tack truck and the operative components of the paving machine must travel over the tack layer before the HMA is distributed on top of it. This equipment becomes covered with tack and requires cleaning. Moreover, the tack layer is disturbed by the wheels or treads of the paving equipment and may not satisfactorily bind the HMA layer to the surface to be paved.

Second, in many paving operations, the lane being paved is located directly adjacent a lane open to traffic. Considerable amounts of tack are sprayed, splattered, or otherwise applied to vehicles in the adjacent lane between the time that the tack is initially dispensed from the truck and the time that it is covered by the HMA. The tack must be removed from the vehicles at the contractor's expense.

Third, the tack may over-cool before the HMA mat can be formed on top of it, thereby leading to decreased bonding effectiveness.

The problems associated with employing a separate tack application truck to apply tack to a surface to be paved could be overcome by modifying a paving machine to apply a coat of tack directly in front of the paving machine's distributing auger, thereby assuring that the tack is covered with HMA almost immediately after it is coated onto the surface to be paved. However, a considerable volume—typically 1,500 to 1,600 gallons—of tack is required for a full day's paving operation. The hopper of the standard paving machine takes up too much of the machine's chassis area to permit a tack storage tank of this capacity to be mounted on the chassis without unacceptably increasing the overall size of the machine. Heretofore, the only solution to this problem was to employ relatively small saddle tanks as the tack storage tanks and to refill these tanks frequently during paving machine operation. The paving operation must be terminated during storage tank filling, resulting in considerable down time and unnecessary seams in the finished mat.

The advent of shuttling or material transfer systems such as those disclosed in co-pending and commonly-assigned allowed U.S. patent application Ser. No. 314,349, filed Sep. 29, 1994 or in U.S. Pat. No. 4,818,139 to Brock et al., permits a paving machine to lay down a mat continuously without interruption for extended periods of time because the hopper can be refilled without terminating the paving operation. However, the advantage of using a shuttling apparatus is vitiated if the paving machine must stop frequently to permit the low capacity saddle tanks to be refilled with tack. Tack application systems incorporating low capacity saddle tanks are especially undesirable for contractors who wish to enjoy the advantages of a shuttling or material transfer machine.

Most modern proposals to incorporate a tack application system in a paving machine have been limited to small scale paving machines which patch potholes and otherwise repair relatively small sections of road. These small scale paving machines do not require large HMA hoppers or large tack storage tanks and may cease operations frequently without degradation of the finished mat. Examples of pavement patching vehicles having a tack application system on the same vehicle which spreads HMA or another aggregate are disclosed in U.S. Pat. No. 4,944,632 to Dillingham and U.S. Pat. No. 5,131,788 to Hulicsko. Limitation in tack storage capacity is not a problem with these relatively small pavement patching vehicles, but the solutions proposed with respect to these vehicles are not applicable to full scale paving machines for the reasons detailed above. Full scale paving machines incorporating an internal tack application system therefore have never gained widespread acceptance in the field.

The need therefore has arisen to provide a full scale paving machine which can form an HMA mat of considerable length while simultaneously and without interruption applying a tack layer on the surface to be paved.

OBJECTS AND SUMMARY OF THE INVENTION

It is therefore a first primary object of the invention to provide a paving machine which is capable of simultaneously and without interruption coating a tack layer on a surface to be paved and of forming a seamless asphalt mat on top of the tack layer.

A secondary object of the invention is to provide a paving machine which meets the first primary object of the invention and the chassis of which is little or no larger than that of a standard paving machine.

Another secondary object of the invention is to provide a paving machine which meets the first primary object of the invention and which incorporates a tack storage tank of sufficient capacity to permit uninterrupted all day operation of the paving machine without refilling the storage tank.

In accordance with a first aspect of the invention, these objects are achieved by providing a paving machine comprising a chassis having a rear end portion, a distributing auger mounted on the rear end portion of the chassis and extending transversely across the chassis, a gravity feed hopper, a screed, a tack storage tank, and a tack material spray assembly. The gravity feed hopper is mounted at the rear end portion of the chassis and has a lower discharge opening which discharges paving materials directly on top of the distributing auger. The gravity feed hopper feeds all paving materials stored therein to the discharge opening without employing any internal conveyors and without the aid of any external conveyors. The screed is mounted on the chassis behind the distributing auger for working paving materials into a mat. The storage tank is mounted on the chassis in front of the gravity feed hopper and stores a tack material. The tack material spray assembly receives tack material from the storage tank and sprays tack material onto a surface to be paved at a location in front of the discharge opening.

The storage tank has a capacity of greater than 1000 gallons, and even more preferably of between 1500 gallons and 1600 gallons, to permit uninterrupted operation for extended periods of time.

The tack material spray assembly preferably comprises 1) a pump having an inlet in fluid communication with tack material in the storage tank and having an outlet, 2) a conduit having an inlet in fluid communication with the outlet of the pump and having an outlet, and 3) a spray bar in fluid communication with the outlet of the conduit. The spray bar is mounted on the paving machine proximate the hopper and extends transversely across the paving machine. A plurality of nozzles are spaced longitudinally along the spray bar and spray tack material onto the surface to be paved at the location in front of the discharge opening. The nozzles are spaced along the spray bar at intervals of about one foot, and each of the nozzles has an orifice that is about 1/32 of an inch in diameter.

Still another secondary object of the invention is to provide a paving machine which meets the first primary object of the invention and which 1) assuredly coats the surface to be paved with a layer of tack at an adequate temperature for subsequent binding and, 2) lays down HMA on top of the tack layer while the tack layer is still hot.

In accordance with another aspect of the invention, this object is achieved by mounting a tack material heater assembly in the vicinity of the storage tank. The tack material heater assembly comprising a burner and a liquid-filled coil which receives heat from the burner and which transfers heat by indirect heat transfer to tack material stored in the storage tank. Preferably, a portion of the coil forms a jacket which surrounds the conduit and the spray bar so as to transfer heat to tack material in the conduit and the spray bar.

A second primary object of the invention is to provide an improved method of simultaneously coating a surface to be paved with a tack layer and of forming a HMA mat on top of the tack layer using a single paving machine.

Another secondary object of the invention is to provide a method which meets the second primary object of the invention and which can continue unabated for prolonged periods of time.

In accordance with yet another aspect of the invention, these objects are achieved by storing paving materials in a gravity feed hopper mounted at a rear end portion of a mobile chassis of a paving machine, storing a tack material in a storage tank mounted on the chassis in front of the hopper, feeding tack material from the storage tank to a tack spray assembly mounted on the chassis, spraying a layer of tack material onto a surface to be paved using the tack spray assembly, and discharging paving materials from a discharge opening of the hopper directly on top of a distributing auger extending transversely across the mobile chassis. All of the paving materials stored in the hopper are fed out of the hopper and onto the distributing auger without employing any internal conveyors and without any external conveyors. Subsequent steps include distributing the paving materials onto the layer of tack material using the distributing auger, and then working the paving materials into a mat.

BREIF DESCRIPTION OF THE DRAWINGS

Preferred exemplary embodiments of the invention are illustrated in the accompanying drawings in which like reference numerals represent like parts throughout, and in which.

Figure 7:
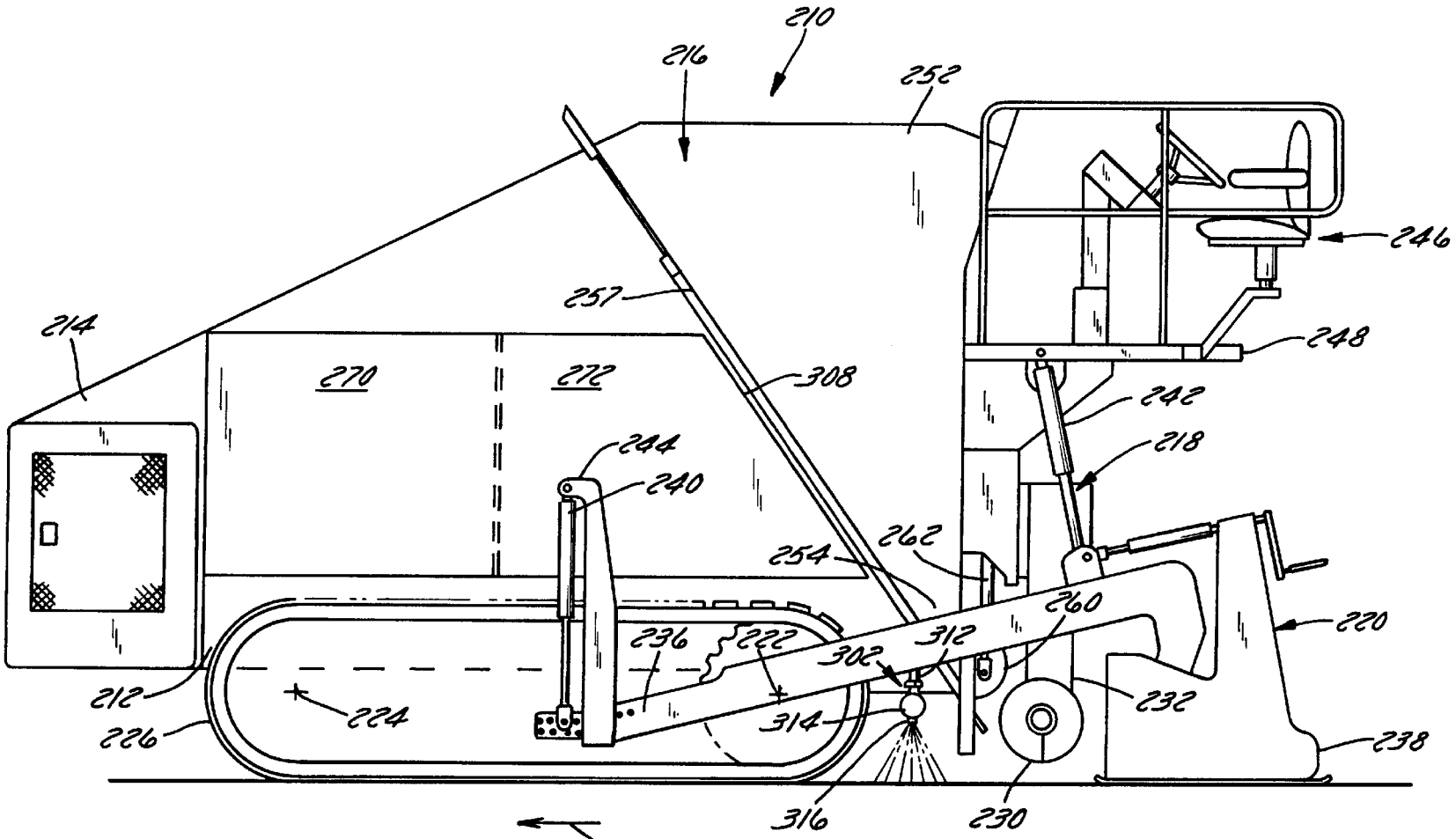
FIG. 7 is a left side-elevation view of a paving machine constructed in accordance with a preferred embodiment of the invention.
Figure 8:
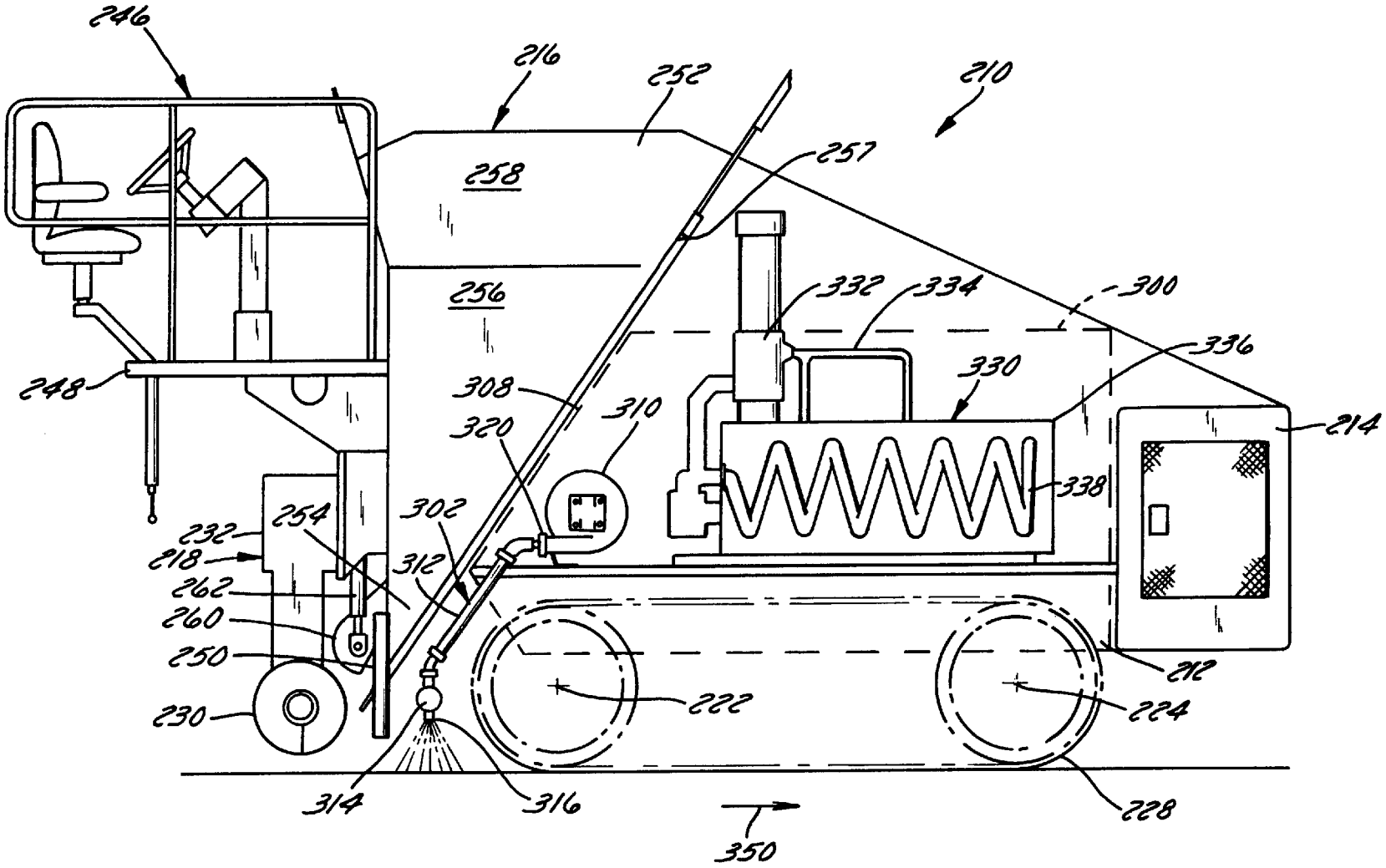
FIG. 8 is a partially cut-away right-side elevation view of the paving machine of FIG. 7 with the screed assembly of the paving machine removed.
Figure 9:
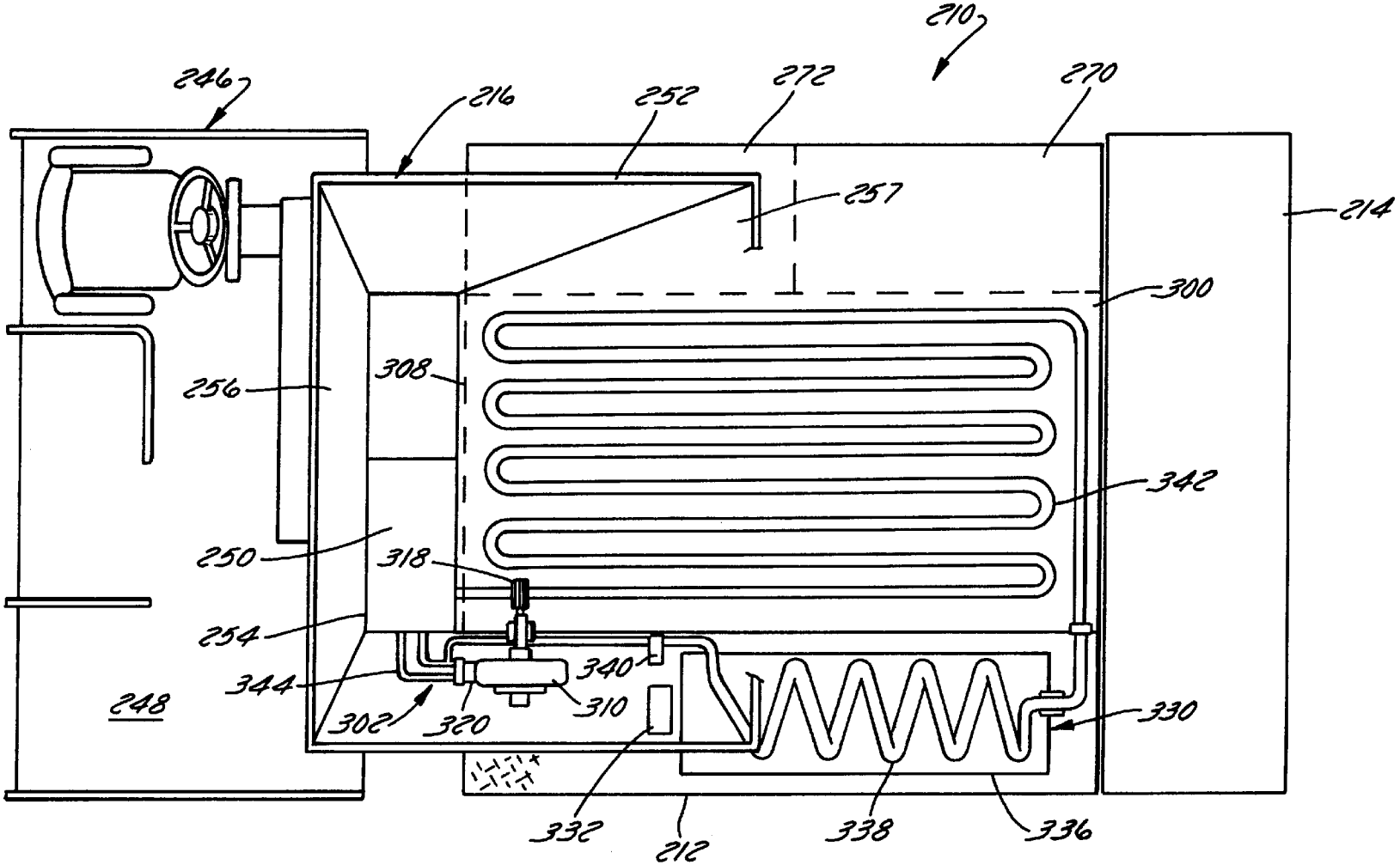
Figure 10:
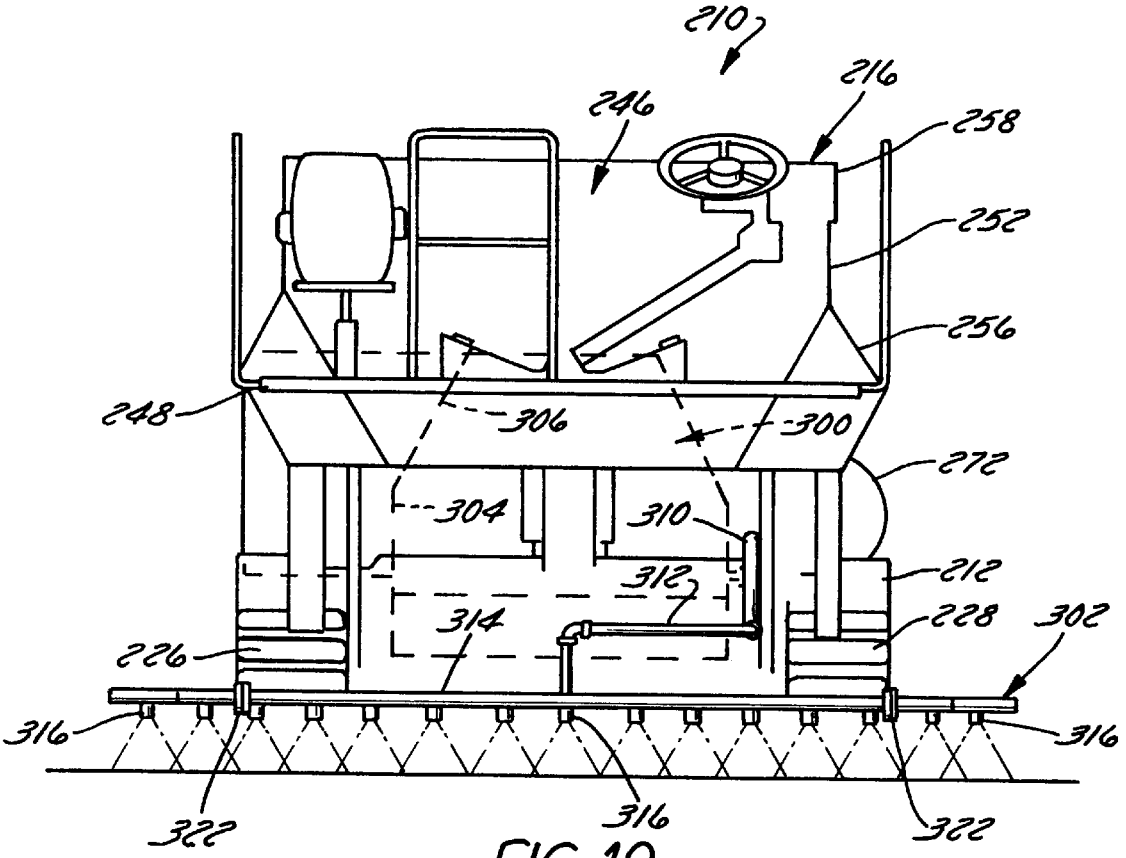
Figure 11:
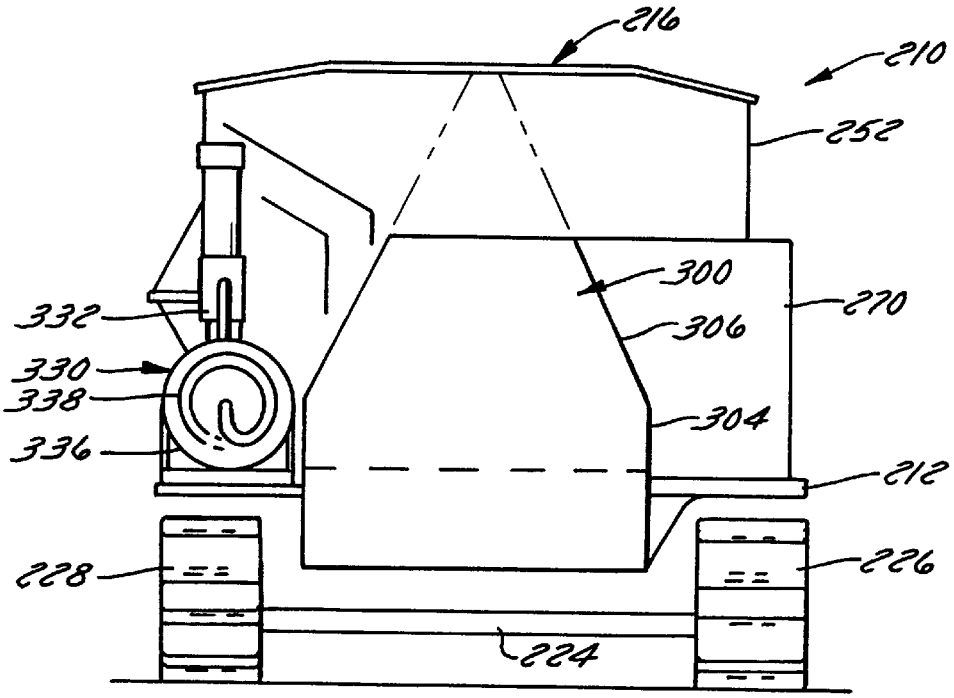

FIG. 9 is a partially cut-away plan view of the paving machine of FIGS. 7 and 8; and FIGS. 10 and 11 are a rear elevation view and a front elevation view, respectively, of the paving machine of FIGS. 7 through 9, with the screed assembly and distributing auger mechanism removed and other components of the paving machine cut away to illustrate better the tack storage tank and tack spray assembly.

DETAILED DESCRIPTION OF THE PREFERRED EMBODIMENTS

1. Résumé

Pursuant to the invention, a paving machine is provided which employs in combination a gravity feed HMA hopper and a tack spray assembly and storage tank. Use of the gravity feed hopper permits all HMA or other paving material stored therein to be discharged directly on top of the paving machine's distributing auger. Moreover, because the gravity feed hopper takes up a relatively small percentage of the horizontal area of the paving machine, a chassis of standard or near standard dimensions can receive a tack storage tank of sufficient capacity to permit the paving machine to operate an entire day without stopping the machine to refill the storage tank. Therefore, if used in conjunction with an HMA shuttling apparatus, the paving machine can simultaneously coat a surface to be paved with a tack material and pave that surface with HMA for prolonged periods of time without stopping to refill either the HMA hopper of the tack storage tank.

2. Construction and Operation of Paving Machine with Gravity Feed Hopper

Referring now to the drawings, a paving machine 10 is illustrated and includes a self-propelled chassis 12 on which are mounted from front to rear an engine 14; a hopper 16; and a paving apparatus including (1) a distributing auger mechanism 18, and (2) a screed assembly 20. The chassis 12 is mounted on front and rear axles 22 and 24 receiving front steering and rear driving wheels 26 and 28, respectively. The front and rear axles 22 and 24 are steered and powered hydrostatically by engine 14 in a known manner.

Screed assembly 20 and distributing auger mechanism 18 may be any conventional mechanisms and, in the illustrated embodiment, are of the type employed by the paving machine manufactured by Roadtec of Chattanooga, Tenn. under the Model No. RP-180. The distributing auger mechanism 18 thus includes a hydrostatically driven screw-type distributing auger 30 extending transversely across the chassis 12 and mounted on a slide 32 which is raiseable and lowerable with respect to a stationary frame 33 via operation of hydraulic cylinders 34. The screed assembly 20 comprises 1) a pair of transversely opposed tow arms 36 (only one of which is illustrated), and 2) a heated vibratory screed 38 pivotally suspended from the rear ends of the tow arms 36. Each tow arm 36 is raiseable and lowerable with respect to the chassis 12 at its front end via a first hydraulic cylinder 40 and at its rear end via a second hydraulic cylinder 42. The front end of each of the tow arms 36 is also pivotally connected to the chassis 12 at a tow point, formed from a suspended bracket assembly 44, so as to permit vertical adjustment of the screed assembly 20 using the cylinders 40 and/or 42.

It should be noted that, in typical paving machines heretofore available, the paving material feed and delivery devices (including the discharge conveyors and distributing auger mechanism) and screed were controlled by separate operators positioned on the paving machine chassis and screed, respectively. It is also not unusual in such machines to have dual stations on the paving machine to permit the machine to be operated from either lateral side with the active operator station being determined by the instantaneous operating conditions of the machine. However, because the paving machine 10 is considerably simplified compared to typical paving machines, it is possible to perform all manual control operations required to run both the entire machine 10 including the screed assembly 20 from a single operator's station or console 46 mounted on a support platform 48 which is in turn mounted on the screed 38. Although the operator's station or console 46 is illustrated as being fixed in position, this station could if desired be mounted on a carriage which is movable transversely across the platform 48 thereby permitting the operator to run the machine 10 from either side of the screed assembly 20 without requiring the dual consoles employed by many paving machines which were heretofore available. Console 46 can also be installed on the rear of the hopper 16 in lieu of the screed 38.

The hopper 16 preferably has a total capacity of about 12 tons to conform with industry standards and is designed to feed by gravity to a discharge opening 50 thereof all of the paving materials stored therein without employing any internal conveyors. To this end, the hopper 16 includes an upper storage portion 52 and a lower discharge portion or discharge chute 54. The storage portion 52 has at least a lower generally frusto-conical section 56 having an upper end of enlarged cross section and having a lower end of reduced cross section connected to an upper end of the discharge chute 54. (The term "frusto-conical" as used herein is not meant to require a square cone but instead denotes any structure the cross section of which decreases substantially continuously from an upper end to a lower end thereof). An upper section 58 of storage portion 52 is preferably provided above the lower section 56 to increase the capacity of the hopper 16 and, in the illustrated embodiment, is of a relatively constant width and terminates at an open top 59. Discharge chute 54 has the discharge opening 50 formed in the bottom end thereof and in use directs paving materials from the storage portion 52 to the discharge opening 50. The discharge chute 54 is also inclined downwardly and rearwardly towards the distributing auger mechanism 18 so as to direct paving materials towards the top of the auger mechanism 18 without the aid of any external conveyors. The transverse length of the discharge opening 50 is preferably roughly the same as the length of the distributing basic auger mechanism 18 so as to promote uniform material feed to all portions of the auger mechanism 18.

The discharge opening 50 in the hopper 16 is selectively closeable by a feeder gate 60 which, in the illustrated embodiment, takes the form of a clam shell gate opened and closed by a drive device 62. The drive device 62 may comprise a screw jack or the like but preferably comprises at least one and even more preferably a pair of hydraulic cylinders suspended from the outer wall of the storage portion 52 and connected to respective end portions of the gate 60.

The hopper 16 is preferably located at the rear of the paving machine 10 to obviate the need for any conveyors to deliver materials to the distributing auger 30 after they are discharged from the hopper. The thus located hopper 16 may however, when fully loaded, tend to overload the back end of the paving machine 10 so as to destabilize the machine 10. This potential problem is overcome by locating the engine 14 and the heavy frame steel components near the front of the chassis 12 and preferably in front of the front axle 22 as illustrated, thereby providing sufficient weight at the front of the machine 10 to counteract any destabilizing effect caused by mounting the hopper 16 at the rear of the machine 10. This construction results in a substantial space between the engine 14 and the hopper 16 which may be left open or may be enclosed as illustrated to form a storage compartment 64 or the like.

In use, the paving machine 10 is readied for operation by positioning it on the roadway surface to be paved and by filling the hopper 16 with paving materials 66. The paving materials 66 could be any of various known materials but will usually comprise HMA and will henceforth be referred to as HMA for the sake of convenience. The hopper 16 is filled by conveying HMA 66 through the open top 59 using a paving materials delivering device such as either a separate conveyor or a shuttling or transfer apparatus such as that disclosed in co-pending and commonly-assigned allowed U.S. patent application Ser. No. 314,349, filed Sep. 29, 1994 (U.S. Pat. No. 5,553,968) or that disclosed in U.S. Pat. No. 4,818,139 to Brock et al. (such an apparatus is required because the hopper 16 is too high to be accessed directly by a dump truck). The sloping side of hopper 16 is preferably heated at this time by engine exhaust or another suitable heat source in order to maintain good flow of HMA to the screed.

Figure 1:
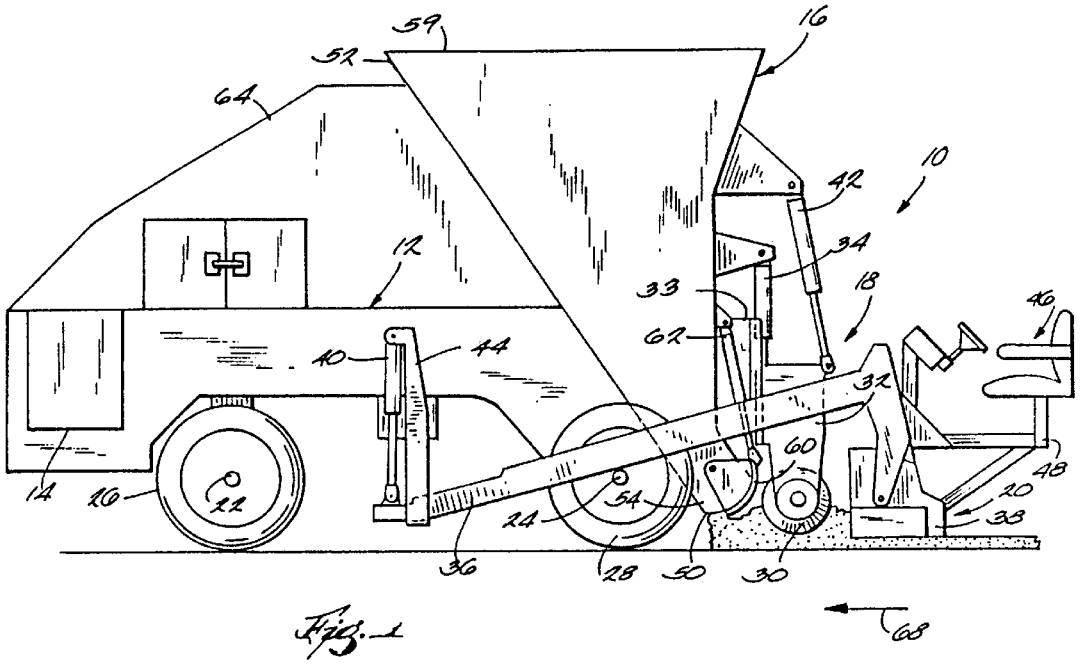
FIG. 1 is a side-elevation view of a paving machine having a gravity feed HMA hopper.
Figure 2:
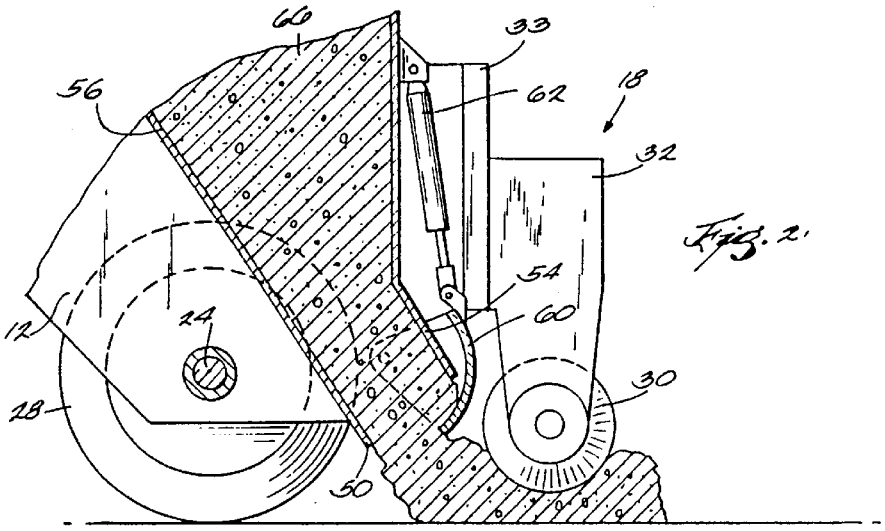
FIG. 2 is a side-sectional elevation view of a portion of the paving machine of FIG. 1 with the screed assembly removed.
Figure 3:
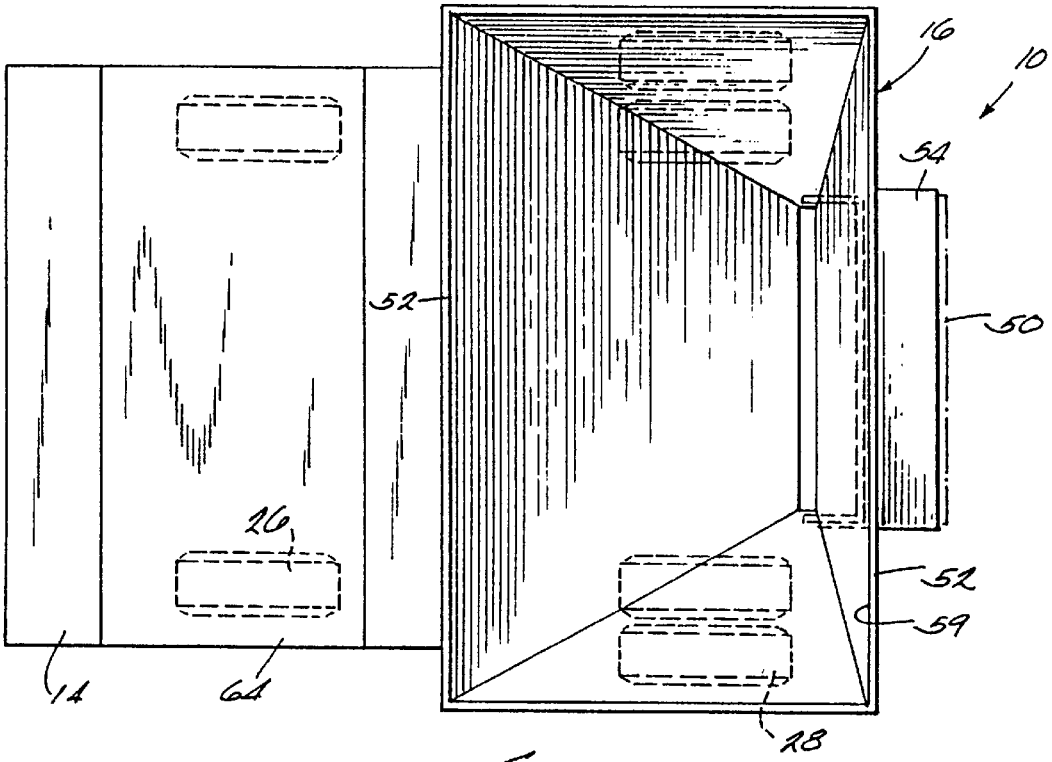
FIG. 3 is a top-plan view of a portion of the paving machine of FIG. 1 with the distributing auger mechanism and the screed assembly removed.

The operator, seated at station or console 46, then controls the engine 14 to propel the paving machine 10 in the direction of the arrow 68 in FIG. 1. Paving is commenced by discharging HMA from the discharge opening 50 of the hopper 16 on top of the distributing auger 30, which then remixes and distributes the HMA. The HMA is then worked into a mat using the screed assembly 20. HMA continues to flow by gravity out of the hopper 16 at a substantially uniform rate (assuming a constant operational state of the feeder gate 60) until the hopper 16 is completely or nearly completely empty. The need for independent controls of internal conveyors to promote a uniform HMA feed is eliminated because the hopper 16 delivers HMA uniformly even when the hopper 16 is nearly empty. Less manual labor is required at the end of the mat due to this superior material flow control than is required by hoppers which employ internal drag slat conveyors.

The rate of HMA delivery from the hopper 16 can be adjusted as required to accommodate changes in vehicle speed and/or in auger and/or screed operation simply by actuating the cylinders 62 to change the position of the feeder gate 60, thus varying the effective cross section of the discharge opening 50. Operation of the cylinders 62 could be controlled manually based on visual observation of at least one of (1) machine speed and (2) the operating conditions of the screed assembly 20 and/or distributing auger mechanism 18 or, in a more sophisticated embodiment, could be controlled automatically based upon sensed operating parameters. The control of HMA discharge using a single feeder gate 60 considerably simplifies paving machine operation and contributes to the ability to control the entire paving machine 10 using a single operator stationed at console 46.

Discharging HMA toward or onto the top of the distributing auger 30 as described above rather than on the ground in front of the distributing auger has at least two advantages. First, when the paving machine 10 is resuming paving from the end of a previously-paved segment, materials are discharged closely adjacent the end of the previously-paved pavement, thus permitting the distributing auger 30 to evenly distribute materials at this location and hence permitting the formation of a more uniform mat by the screed assembly 20 with a less noticeable seam between the paved segments. Second, any material segregation which occurs when materials are stored in or discharged from the hopper 16 is alleviated by the remixing of the materials by the distributing auger 30. The remixing is significantly enhanced compared to prior art devices because all or nearly all of the materials discharged from the hopper 16 are spread by the distributing auger 30. By contrast, distributing augers of prior art paving machines contact only the upper portions of windrowed paving materials, leaving the lower portions undisturbed.

3. Construction and Operation of Modified Form of Gravity Feed Hopper

Figure 4:
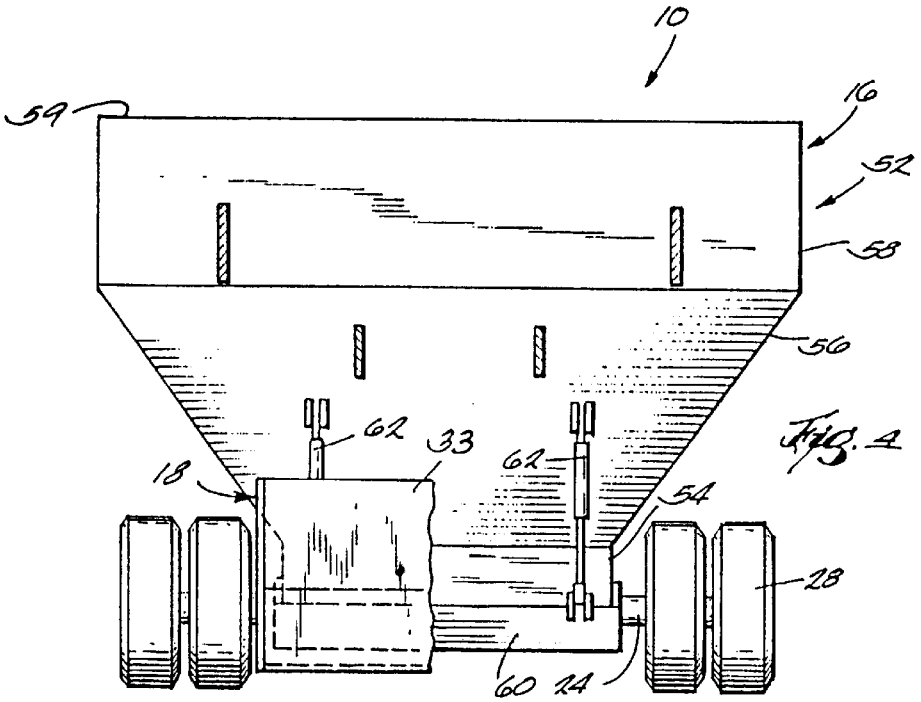
FIG. 4 is a partially cut-away rear elevation view of a portion of the paving machine of FIGS. 1–3 with the distributing auger mechanism and screed assembly removed.
Figure 5:
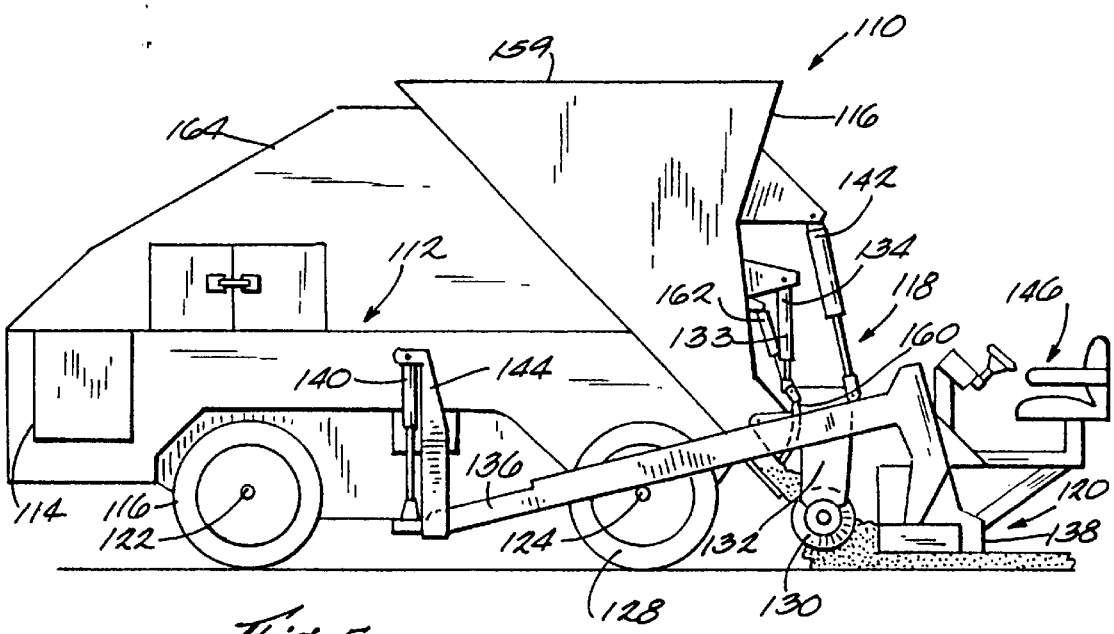
FIG. 5 is a side-elevation view of a modified form of the paving machine of FIGS. 1–4.
Figure 6:
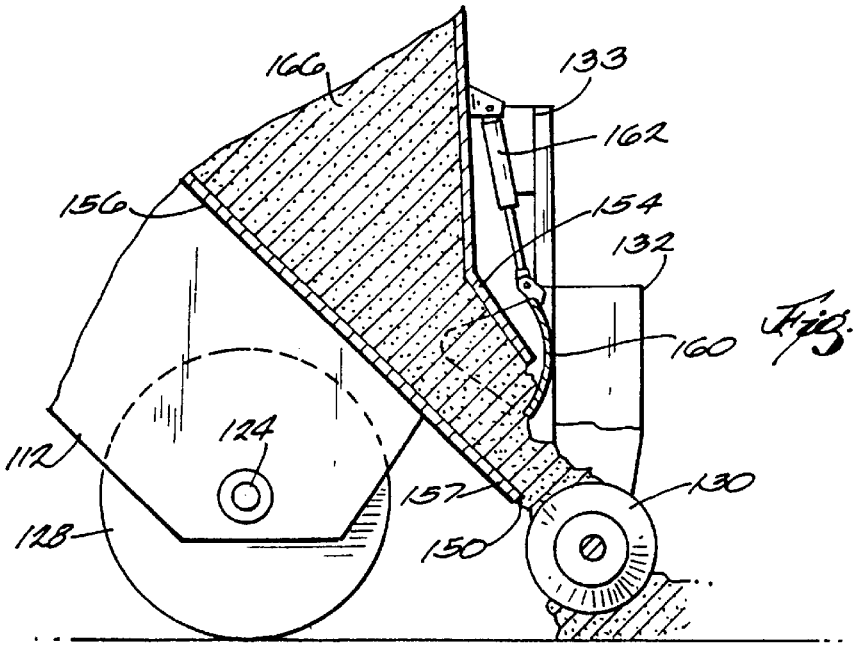
FIG. 6 is a side-sectional elevation view of a portion of the paving machine of FIG. 5.

The paving machine 10 illustrated in FIGS. 1–4 is capable of discharging all materials towards the top of the distributing auger 30 but, because of the illustrated relationship between the hopper discharge opening 50 and the distributing auger 30, may not be capable of adequately discharging materials directly on top of the distributing auger 30. An arrangement better suited for this purpose is illustrated in FIGS. 5 and 6 which is identical in construction and operation to the paving machine 10 of FIGS. 1–4 except for the locations of the hopper 116 and discharge opening 150 relative to the distributing auger 130. Elements of the modified paving machine 110 of FIGS. 5 and 6 corresponding to those of the paving machine 10 of FIGS. 1 and 4 are designated by the same reference numerals, incremented by 100.

The paving machine 110 of FIGS. 5 and 6 differs from the paving machine 10 of FIGS. 1–4 only in that the hopper 116 and discharge opening 150 are located slightly behind and above the locations of the corresponding hopper 16 and discharge opening 50 of the machine 10 of FIGS. 1–4. This arrangement assures that the discharge opening 150 is located directly above the distributing auger 130. "Directly above" as used herein does not mean that all or even any of the discharge opening 150 be located in the same vertical plane as the distributing auger 130. Rather, "directly above" means that the discharge opening 150 is located above the distributing auger 130 and sufficiently close to the distributing auger 130 that materials discharged from the opening 150 fall onto the upper portions of the distributing auger 130 as opposed to the ground. Shifting the discharge opening 150 in this manner can if desired can be facilitated by extending the front wall 157 of the hopper 116 beyond the gate 160 as illustrated. The resulting construction assures remixing of paving materials and a uniform boundary between paved segments as discussed above.

4. Construction and Operation of Paving Machine with Gravity Feed Hopper and Tack Application System The inventor has discovered that a paving machine constructed in accordance with either the embodiment of FIGS. 1–4 or the embodiment of FIGS. 5 and 6 can be readily modified to incorporate a large capacity tack storage tank and a tack spray assembly. The resulting paving machine will exhibit all of the advantages discussed above, and additionally will be capable of coating the surface to be paved with a layer of a tack material for prolonged periods of time without interruption.

Referring now to FIGS. 7–11, a paving machine 210 is illustrated which is in many respect identical to the paving machine of 110 of FIGS. 5 and 6. The paving machine 210 includes a self-propelled chassis 212 on which are mounted from front to rear 1) an engine 214; 2) a hydraulic fluid tank 270, a fuel tank 272, and a tack storage tank 300; 3) a gravity feed hopper 216; 4) a tack spray assembly 302; 5) a distributing auger mechanism 218; and 6) a screed assembly 220. The hydraulic fluid tank 270 and fuel tank 272 are located laterally beside the tack storage tank 300. All three tanks 270, 272, and 300 are mounted on a portion of the chassis 212 which would normally be at least partially occupied by the machine's HMA storage hopper but which is available in the chassis 212 due to the location and configuration of the gravity feed hopper 216.

The chassis 212 is mounted on a front steering axle 222 and a rear axle 224 driven hydrostatically by an engine 214 in a known manner. The axles 222 and 224 are supported on tracks 226 and 228 rather than wheels as in the previous embodiments to support the additional weight of the tack storage tank 300, tack spray system 302, and 1,500 to 1,600 gallons (11,000 to 13,000 pounds) of tack. The engine 214 is also somewhat larger than the engine of the previous embodiments to accommodate the added weight of the tack storage tank 300 and the tack spray assembly 302 and to provide power to the pumps 310 and 340 detailed below.

The screed assembly 220 and distributing auger mechanism 218 are identical to the screed assembly 120 and distributing auger mechanism 118 described above. Distributing auger mechanism 218 therefore includes a hydrostatically driven helical screw type distributing auger 230 extending transversely across the chassis 212 and mounted on a slide 232 which is raised and lowered with respect to the chassis 212 via operation of hydraulic cylinders (not shown in this embodiment). Referring to FIG. 7, the screed assembly 220 comprises 1) a pair of transversely opposed tow arms 236 (only one of which is illustrated), and a heated vibratory screed 238 pivotally suspended from the rear end of the tow arms 236. Each tow arm 236 is raiseable and lowerable with respect to chassis 12 at its front end via a first hydraulic cylinder 240 and at its rear end via a second hydraulic cylinder 242. The front end of each of the tow arms 236 is also pivotally connected to the chassis 212 at a tow point, formed from a suspended bracket assembly 244, so as to permit vertical adjustment of the screed assembly 220 using the cylinders 240 and 242.

As in the previous embodiments, all manual control operations required to operate the entire paving machine 210, including the screed assembly 220, are performed from a single operator's station or console 246 mounted on a support platform 248. In the illustrated embodiment, the platform 248 is mounted on the rear end portion of the hopper 216 to facilitate observation of the entire paving machine 210. The station or console 246 could be fixed in position or could be moveable transversely across the platform 248 as illustrated in FIGS. 9 and 10.

The hopper 216 is identical to the hopper 116 described above. Hopper 216 therefore 1) has a total capacity of more than 10 tons, preferably about 12 tons, and 2) is designed to feed by gravity to a discharge opening 250 thereof all of the paving materials stored therein without employing any internal or external conveyors. The hopper 216, like the hopper 116, therefore includes an upper storage portion 252 and a lower discharge portion 254. The storage portion 252 has a lower generally frustoconical section 256 including a rear wall 257 which is sloped downwardly and rearwardly from an upper end thereof. Storage portion 252 also has an enlarged upper section 258 to increase the capacity of the hopper 216. Discharge portion 254 has the discharge opening 250 formed in the bottom end thereof and directs paving materials from the storage portion 252 to the discharge opening 250 and then to the distributing auger 230 as detailed above. The discharge opening 250 of the hopper 216 is selectively closeable by a clam shell gate 260 operated by hydraulic cylinders 262.

The tack storage tank 300 and tack spray assembly 302 are designed to store a tack material and to coat the tack material onto the surface to be paved at a location adjacent the distributing auger 230. The tack material, hereafter referred to simply as "tack," may comprise any material suitable for bonding the HMA mat to the surface being paved including an emulsified oil or liquid asphalt.

The tank 300 is mounted on the vehicle chassis 212 directly in front of the gravity feed hopper 216. Tank 300 preferably has a capacity of over 1,000 gallons, and more preferably between 1,500 and 1,600 gallons, in order to be capable of storing sufficient tack to permit the paving machine 210 to continue operation without interruption for up to an entire day. As discussed briefly above, mounting a tack storage tank of this capacity on a paving machine chassis of standard or near-standard dimensions is made possible by the inventive gravity feed hopper 216, which takes up a relatively small amount of the chassis' area, thereby permitting the mounting of a relatively large tack tank 300 in front of the hopper 216. The tack storage tank 300 has a generally rectangular lower portion 304 and a generally frusto-conical upper portion 306. The tank 300 also has a rear wall 308 which is located closely adjacent the sloped hopper wall 257 and which is sloped or inclined so as to generally compliment the slope of the hopper wall 257.

The tack spray assembly 302 is designed to receive tack from the tack storage tank 300 and to coat it on the surface to be paved at a location just in front of the distributing auger mechanism 218 so that the tack layer is covered with HMA almost immediately after it is coated onto the surface to be paved. The tack spray system 302 includes a pump 310, a feed conduit 312, a tack spray bar 314, and a plurality of nozzles 316. The pump 310 has an inlet 318 extending through the side wall of the tack storage tank 300 and an outlet connected to an inlet of the feed conduit 312, the outlet of which is connected to the tack spray bar 314. The tack spray bar 314, which is mounted on the chassis frame 212 by supports 322 (FIG. 10), extends across the full transverse length of the paving machine 210 at a location behind the tracks 226 and 228 and in front of the distributing auger 230 and gravity feed hopper discharge opening 250. The nozzles 316 are spaced evenly along the spray bar 314, preferably at intervals of about one foot, and are directed downwardly so as to spray tack onto the surface to be paved at a location directly in front of the distributing auger 230. The nozzles 316 are somewhat smaller than nozzles commonly employed in tack spray assemblies because the paving machine 210 moves forwardly during a paving operation at only 20 to 40 feet per minute, much slower than the 5 to 10 miles per hour speed of the typical truck mounted tack spray assembly. It is currently contemplated that each nozzle 316 need only have a diameter of about 1/32 of an inch to achieve a desired tack coating of 0.05 gallons per square yard of coated surface when the paving machine 210 travels at 20 to 40 feet per minute.

A tack heater 330 is preferably provided to maintain the temperature of at least the tack in the tank 300, and preferably both the tack in the tank 300 and the tack being transferred from the tank 300 to the spray bar 314, at a sufficiently high temperature to bond the HMA mat to the surface being paved. The heater 330 includes a conventional diesel burner 332 and an expansion tank 334 which heat oil or another heat transfer liquid in the liquid coils 338 of a conventional heat exchanger 336. The heated oil is then conveyed by a pump 340 through a serpentine coil 342 located within the lower portion of the tack storage tank 300 (FIG. 9) and then back to the heat exchanger 336. In the preferred and illustrated embodiment, an insulated tubular jacket 344 surrounds at least the feed conduit 312, and preferably both the feed conduit 312 and the spray bar 314. Some or even all of the heated oil withdrawn from the heat exchanger 336 is conveyed through this jacket 344 before being forced through the coil 342 in the tank 300. This maintains the temperature of the tack in the tank 300, in the conduit 312, and in the spray bar 314 acceptably high for bonding. This temperature should be about 130° F. when a standard emulsion is used as the tack.

In use, the paving machine 210 is readied for operation by filling the hopper 216 with about 12 tons of HMA and the tack storage tank with 1,500 to 1,600 gallons of previously-heated tack. The heater 330 is then activated to maintain the temperature of the tack in the tank 300 and in the tack spray assembly 302 at about 130° F. The paving machine 210 is then positioned with the tracks 226 and 228 supported on the surface to be paved and the tack spray bar 314 and distributing auger 230 located closely adjacent a previously-paved section. Then, the pump 310 is actuated, the clam shell gate 260 is opened, and the distributing auger 230 is lowered and driven to rotate. The paving machine 210 simultaneously 1) coats the surface to be paved with about 0.05 gallons of tack per square yard, and 2) discharges HMA from the hopper 216 onto the distributing auger 230. The paving machine 210 is then propelled by the tracks 226 and 228 to move forwardly or in the direction of the arrow 350 in FIGS. 7 and 8 so that the distributing auger 230 distributes HMA on top of the tack coated surface and so that the screed (FIG. 7) works the thus distributed materials into a mat. Because no tracks or other devices traverse the tack coated surface before it is covered with HMA, the tack layer remains undisturbed until it is covered with HMA. Moreover, because the HMA is distributed on top of the tack layer almost immediately after tack coating, 1) the tack is still hot enough for optimal bonding when it covered with HMA, and 2) there is little if any opportunity for vehicles or other paving equipment in the vicinity of the paving machine to become coated with tack.

Paving can continue unabated in this manner for extended periods of time. The hopper 216 can be refilled either intermittently or continuously during paving machine operation by a shuttle or transfer vehicle of the type described above. Accordingly, assuming that the fuel tank 272 is sufficiently large to negate the need to refuel the paving machine 210 frequently, paving theoretically can continue unabated for an entire working day or until the large 1,500 to 1,600 gallon capacity of the tack storage tank 300 is exhausted.

Many changes and modifications could be made to the invention without departing from the spirit thereof. The scope of these changes will become apparent from the appended claims.

I claim:

1. A paving machine comprising:

(A) a chassis having a rear end portion;

(B) a distributing auger mounted on said rear end portion of said chassis and extending transversely across said chassis;

(C) a gravity feed hopper mounted on said rear end portion of said chassis;

(D) discharge means, having an inlet communicating with said gravity feed hopper and an outlet located directly above said distributing auger, for discharging paving materials directly on top of said distributing auger, wherein said gravity feed hopper feeds all paving materials stored therein to said discharge means without employing any internal conveyors and without the aid of any external conveyors;

(E) a screed which is mounted on said chassis behind said distributing auger and which works paving materials into a mat, wherein said distributing auger is located between said gravity feed hopper and said screed;

(F) a storage tank which is mounted on said chassis in front of said gravity feed hopper and which stores a tack material; and (G) a tack material spray assembly which receives tack material from said storage tank and which sprays tack material onto a surface to be paved at a location in front of said discharge opening.

2. A paving machine as defined in claim 1, wherein said storage tank has a capacity of greater than 1000 gallons.

3. A paving as defined in claim 2, wherein said storage tank has a capacity of between 1500 gallons and 1600 gallons.

4. A paving machine as defined in claim 1, wherein said tack material spray assembly comprises 1) a pump having an inlet in fluid communication with tack material in said storage tank and having an outlet, 2) a conduit having an inlet in fluid communication with said outlet of said pump and having an outlet, 3) a spray bar in fluid communication with said outlet of said conduit, said spray bar being mounted on said paving machine proximate said gravity feed hopper and extending transversely across said paving machine, and 4) a plurality of nozzles which are spaced longitudinally along said spray bar and which spray tack material onto the surface to be paved at said location in front of said discharge opening.

5. A paving machine as defined in claim 4, further comprising a tack material heater assembly supported on said chassis, said tack material heater assembly comprising a burner and a liquid-filled coil which receives heat from said burner and which transfers heat by indirect heat transfer to tack material stored in said storage tank.

6. A paving machine as defined in claim 5, wherein a portion of said coil forms a jacket which surrounds said conduit and said spray bar so as to transfer heat to tack material in said conduit and said spray bar.

7. A paving machine as defined in claim 4, wherein said nozzles are spaced along said spray bar at intervals of about one foot, and wherein each of said nozzles has an orifice that is about 1/32 of an inch in diameter.

8. A paving machine as defined in claim 1, wherein said gravity feed hopper has a storage capacity of over 10 tons.

9. A paving machine as defined in claim 8, wherein said storage tank has a storage capacity of over 1,000 gallons.

10. A paving machine comprising:

(A) a chassis having a rear end portion;

(B) a distributing auger mounted on said rear end portion of said chassis and extending transversely across said chassis;

(C) a gravity feed hopper mounted on said rear end portion of said chassis and having a lower discharge opening which discharges paving materials directly on top of said distributing auger and an upper inlet configured to receive paving materials directly from a paving material delivery device located off board said paving machine, wherein said gravity feed hopper feeds all paving materials stored therein to said discharge opening without employing any internal conveyors and without the aid of any external conveyors, wherein said gravity feed hopper includes a storage portion for storing paving materials, said storage portion including 1) an upper section for increasing the capacity of said gravity feed hopper, said upper section having a relatively constant width and terminating at an open top, and 2) a lower generally frusto-conical section having an upper end of enlarged cross section and a lower end of reduced cross section, said upper end of enlarged cross section being connected to said upper section, a discharge portion for directing paving materials from said storage portion to said discharge opening, a discharge portion upper end connected to said lower end of reduced cross section and a bottom end in which said discharge opening is formed, and a gate for selectively closing said discharge opening, said gate being mounted on said discharge portion of said gravity feed hopper, and wherein 1) said discharge opening is located between said storage portion and said distributing auger and 2) said discharge portion is inclined downwardly and rearwardly towards said distributing auger so as to direct paving materials towards said distributing auger without the aid of any external conveyors;

(D) a screed which is mounted on said chassis behind said distributing auger and which works paving materials into a mat;

(E) a storage tank which is mounted on said chassis in front of said gravity feed hopper and which stores a tack material; and (F) a tack material spray assembly which receives tack material from said storage tank and which sprays tack material onto a surface to be paved at a location in front of said discharge opening.

11. A paving as defined in claim 10, wherein said storage tank has a rear wall which is sloped so as to generally complement a slope of a front wall of said lower generally frusto-conical section of said gravity feed hopper.

12. A paving machine comprising:

(A) a chassis having a rear end portion;

(B) a distributing auger mounted on said rear end portion of said chassis and extending transversely across said chassis;

(C) a gravity feed hopper mounted on said rear end portion of said chassis and having a lower discharge opening which discharges paving materials from said paving machine, wherein said gravity feed hopper feeds all paving materials stored therein to said discharge opening without employing any internal conveyors and without the aid of any external conveyors, and wherein said gravity feed hopper has a capacity of over 10 tons;

(D) a screed which is mounted on said chassis and which works paving materials into a mat;

(E) a storage tank which is mounted on said chassis in front of said gravity feed hopper and which stores a tack material, said storage tank having a capacity of over 1000 gallons; and (F) a tack material spray assembly which receives tack material from said storage tank and which sprays tack material onto a surface to be paved at a location in front of said discharge opening.

13. A paving machine as defined in claim 12, wherein said discharge opening discharges paving materials directly on top of said distributing auger.

14. A paving machine as defined in claim 12, wherein said gravity feed hopper has a capacity of about 12 tons and said storage tank has a capacity of between 1500 gallons and 1600 gallons.

15. A paving machine as defined in claim 12, wherein said tack material spray assembly comprises 1) a pump having an inlet in fluid communication with tack material in said storage tank and having an outlet, 2) a conduit having an inlet in fluid communication with said outlet of said pump and having an outlet, 3) a spray bar in fluid communication with said outlet of said conduit, said spray bar being mounted on said paving machine proximate said gravity feed hopper and extending transversely across said paving machine, and 4) a plurality of nozzles which are spaced longitudinally along said spray bar and which spray tack material onto the surface to be paved at said location in front of said discharge opening, wherein each of said nozzles has an orifice that is about 1/32 of an inch in diameter; and further comprising a source of heated oil and a jacket which is connected to and receives oil from said source of heated oil, said jacket surrounding said conduit and said spray bar so as to transfer heat to tack material in said conduit and said spray bar.

16. A method comprising:

(A) feeding paving materials directly into a gravity feed hopper of a paving machine from a paving material delivery device located off-board said paving machine, said paving materials including hot mix asphalt, said gravity feed hopper being mounted at a rear end portion of a mobile chassis of said paving machine;

(B) storing said paving materials in said gravity feed hopper, wherein the steps (A) and (B) comprise feeding over 10 tons of paving materials into said gravity feed hopper and storing over 10 tons of paving materials in said gravity feed hopper;

(C) storing a tack material in a storage tank mounted on said chassis in front of said gravity feed hopper;

(D) feeding tack material from said storage tank to a tack spray assembly mounted on said chassis;

(E) spraying a layer of tack material onto a surface to be paved using said tack spray assembly;

(F) discharging said paving materials from a discharge opening of said gravity feed hopper directly on top of a distributing auger extending transversely across said mobile chassis, wherein all of the paving materials stored in said gravity feed hopper are fed out of said gravity feed hopper and onto said distributing auger without employing any internal conveyors and without the aid of any external conveyors; then (G) distributing said paving materials onto said layer of tack material using said distributing auger; and then (H) working said paving materials into a mat using said paving machine.

17. A method as defined in claim 16, further comprising propelling said paving machine along the surface to be paved at a rate of 20 feet per minute to 40 feet per minute during said steps (C) through (G).

18. A method as defined in claim 16, wherein said spraying step forms a tack material layer having a volume of about 0.05 gallons per square yard.

19. A method as defined in claim 16, wherein the step (C) comprises storing over 1,000 gallons of said tack material in said storage tank.

20. A method as defined in claim 19, wherein the step (C) comprises storing over 1,500 gallons of said tack material in said storage tank.

* * * * *